US005595127A

United States Patent [19]

Eustace et al.

[11] Patent Number: 5,595,127

[45] Date of Patent: Jan. 21, 1997

[54] SHELVING SYSTEM

[75] Inventors: Brian Eustace, Sierra Madre; Robert Zarate, Studio City, both of Calif.

[73] Assignee: Hon Industries Inc., Muscatine, Iowa

[21] Appl. No.: 349,825

[22] Filed: Dec. 6, 1994

[51] Int. Cl.[6] ..... A47B 9/00

[52] U.S. Cl. ..... 108/109; 108/193; 211/187

[58] Field of Search ..... 108/107, 109, 108/192, 193; 211/187

[56] References Cited

U.S. PATENT DOCUMENTS

| | | | |
|---|---|---|---|
| 1,059,464 | 4/1913 | Hine | 108/107 |
| 2,967,625 | 1/1961 | Hoogenstyn | 108/109 |
| 3,754,517 | 8/1973 | Hassel et al. | 108/107 |
| 4,015,545 | 4/1977 | Kurokawa | 108/107 |
| 5,279,232 | 1/1994 | Gollick | 108/193 |

FOREIGN PATENT DOCUMENTS

| | | | |
|---|---|---|---|
| 0985765 | 3/1965 | United Kingdom | 211/187 |

*Primary Examiner*—Peter M. Cuomo
*Assistant Examiner*—Anthony D. Barfield
*Attorney, Agent, or Firm*—Jones, Day, Reavis & Pogue

[57] ABSTRACT

A shelving unit comprises a pair of side panels each having a front edge and a rear edge with the edges formed into generally C-shaped channels defining vertical upright support members. A plurality of vertically spaced slots are provided in each support member defining a plurality of vertically spaced rails. A pair of notches are formed in each rail. A shelf is provided with outwardly extending hooks on opposed edges thereof for cooperation with the notches of the support member rails. The shelves are thereby supported by the support members and may be adjusted to any desired pre-selected height.

26 Claims, 6 Drawing Sheets

SHELVING SYSTEM

BACKGROUND OF THE INVENTION

1. Field of the Invention

The present invention relates generally to a metal shelving system and it relates more particularly to a shelving system which can be easily assembled and disassembled and wherein the shelves are readily adjustable to various heights.

2. Description of the Prior Art

Adjustable shelving employing shelves constructed of sheet metal is well known and extensively used in a variety of environments and shelf loading conditions. Shelving of this general type often falls into a category referred to as knock-down shelving because it is capable of being assembled and disassembled time and again. Conventional knock-down shelving employs vertical corner posts designed to have shelves mounted thereon at spaced vertical increments. A cooperating corner structure facilitates the mounting of the shelf to the corner post. While many corner mounting structures of known shelving units have provided adequate strength and rigidity for supporting shelf loads, often these known units are difficult or time consuming to assemble.

In one fairly common type of corner structure used by many conventional shelving units, each shelf is provided with corner structures comprising a closed collar structure defining a vertical opening for accommodating a corner post. With such an arrangement, all four corner posts must be slidably inserted through the collars associated with the corners of each shelf or in the alternative, the individual shelves must be positioned with the collars aligned with the posts so that the shelf can be slid downwardly along the posts into position. Once the collars and posts have been properly interfitted, separate wedge members of fasteners are used to fixedly secure the shelf to the post at the desired height. This type of structural arrangement, however, can be complex and can involve small parts which are easily misplaced. Further, this type of shelving unit does not permit the addition or removal of an intermediate shelf without first requiring disassembly of other shelves disposed either above or below the intermediate shelf. This greatly restricts usage of the shelving because changes in shelf configuration require complex disassembly and reassembly procedures. Examples of such a shelving unit are disclosed in U.S. Pat. No. 3,523,508 and U.S. Pat. No. 3,604,369 issued to Maslow.

Another conventional configuration for known shelving units employs a corner structure which requires the use of threaded fasteners or the like for securing the individual shelves to the corner posts. In units of this type, often times the shelf itself directly connects to the corner posts by threaded fasteners or, in the alternative, a special corner member such as a collar is fitted onto the corner post and then this corner member in turn is secured to the shelf by threaded fasteners. Assembling shelving units of this type can be manually difficult due to the requirement of properly positioning and holding all of the various pieces while at the same time attempting to position and secure the threaded fasteners. Such units often require two persons to accomplish the assembly operation.

Another problem associated with many known shelving units is the complexity with which the supporting corner structure is made. Many of the known corner structures either employ a substantial number of pieces and/or pieces of relatively complex configuration which are expensive to fabricate. Such complex corner arrangements not only undesirably increase the cost of the shelving unit but also can result in complex and difficult assembly techniques. Examples of known shelving units of this general type are disclosed in U.S. Pat. No. 4,582,001 issued to Leikarts and U.S. Pat. No. 4,615,278 issued to Cabrelli.

Accordingly, it is desirable to provide a knock-down shelving unit having an improved corner structure for rigidly securing shelves thereto.

It is further desirable to provide an improved shelving unit which is capable of inexpensive fabrication but yet is reliable under heavy shelf loads.

Still further, it is desirable to provide a shelving unit which can be readily assembled and disassembled without the need for mechanical fasteners or tools and which can be assembled and disassembled by a single person.

Still further, it is desirable to provide a shelving unit in which shelves may be easily reconfigured without the need to disassemble and reassemble any other parts of the unit.

Still further, it is desirable to provide a shelving unit which minimizes the shelf .space dedicated to providing for the shelf support structure thereby maximizing available shelf space.

SUMMARY OF THE INVENTION

The present invention overcomes the disadvantages of the prior art by providing a shelving unit comprising a pair of side panels each having a front edge and a rear edge with the edges formed into generally C-shaped channels defining vertical upright support members. A plurality of vertically spaced slots are provided in each support member defining a plurality of vertically spaced rails. A pair of notches are formed in each rail. A shelf is provided with outwardly extending hooks on opposed edges thereof for cooperation with the notches of the support member rails. The shelves are thereby supported by the support members and may be adjusted to any desired preselected height.

BRIEF DESCRIPTION OF THE DRAWINGS

The features and advantages of the invention will become apparent upon a reading of the following detailed description taken in conjunction with the accompanying drawings wherein.

DETAILED DESCRIPTION OF THE PREFERRED EMBODIMENT

Figure 1:
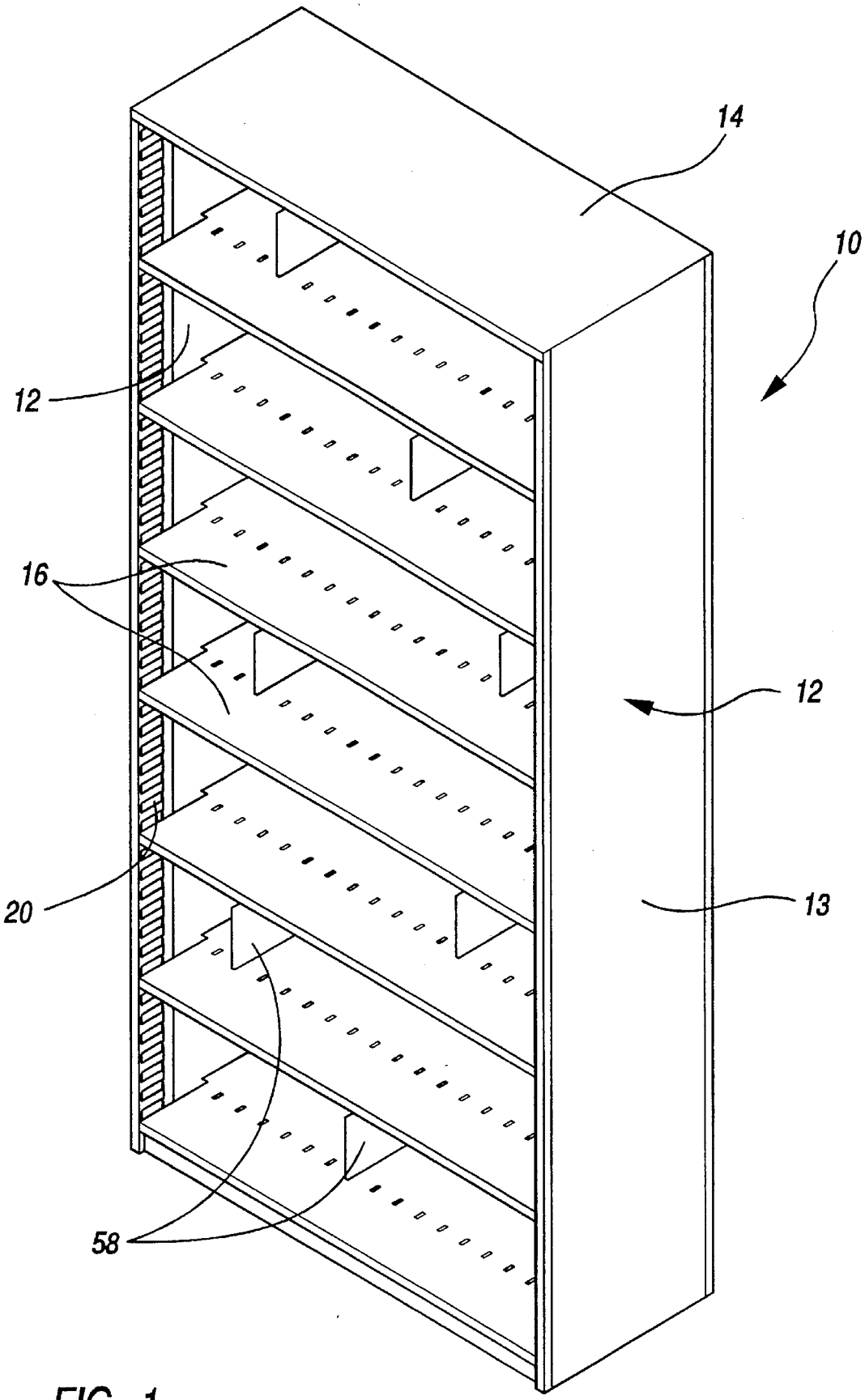
FIG. 1 is an isometric view of a shelving unit constructed in accordance with the invention.

Referring now to the drawings, and initially to FIG. 1, a shelving unit in accordance with the invention is designated generally by the reference numeral 10 and includes an enclosure comprising a pair of side walls 12 and a top wall 14. The top wall 14 is preferably formed like a lid with a planar surface having depending flanges for engaging upper edges of the side wall 12. Supported between the side walls 12 are a plurality of individual shelves 16. The shelves 16 are supported by corner upright support structures 20 as will be described in detail hereinafter.

Figure 2:
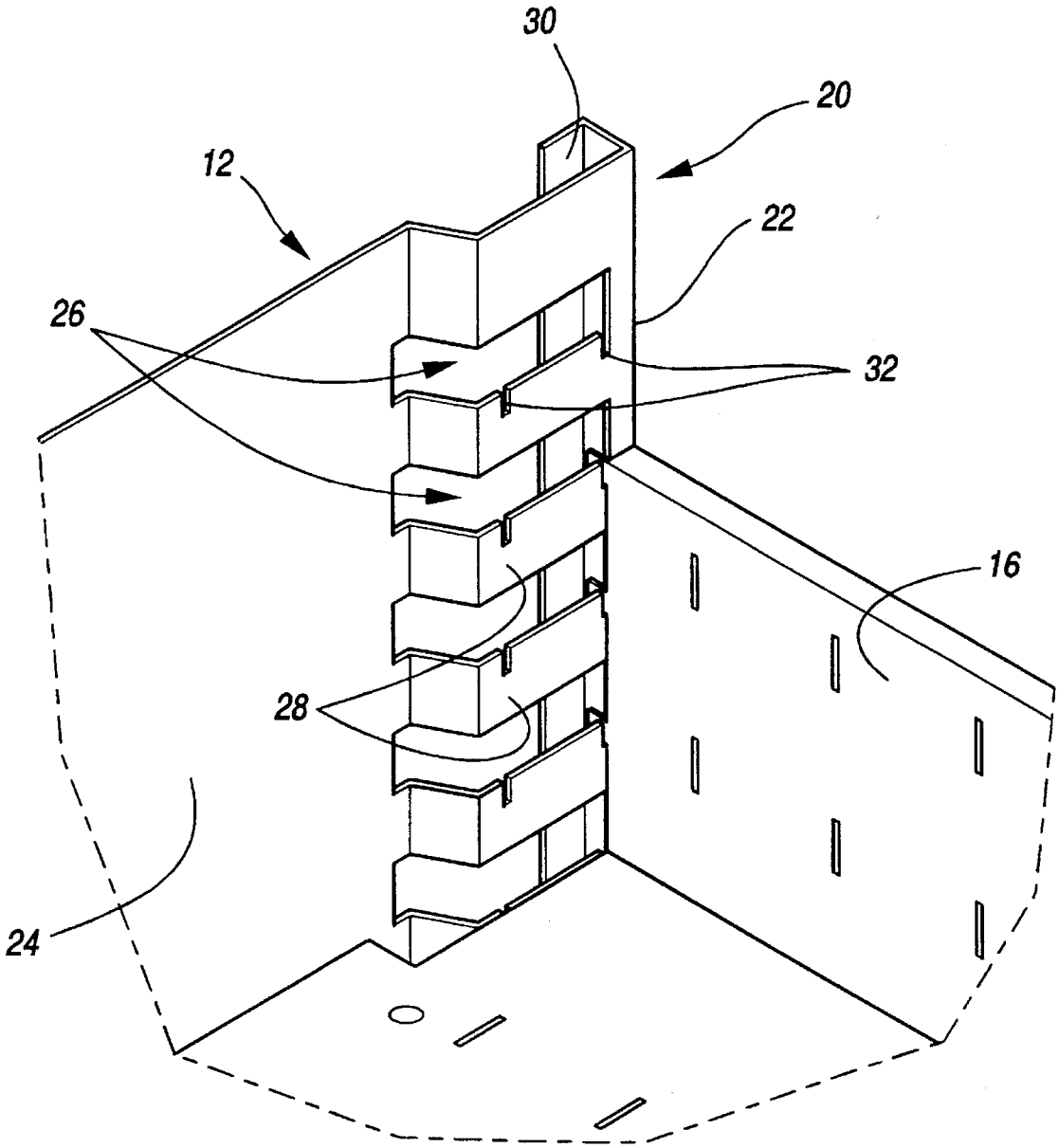
FIG. 2 is an enlarged fragmentary isometric view of a rear corner of the shelving unit shown in FIG. 1.
Figure 8:
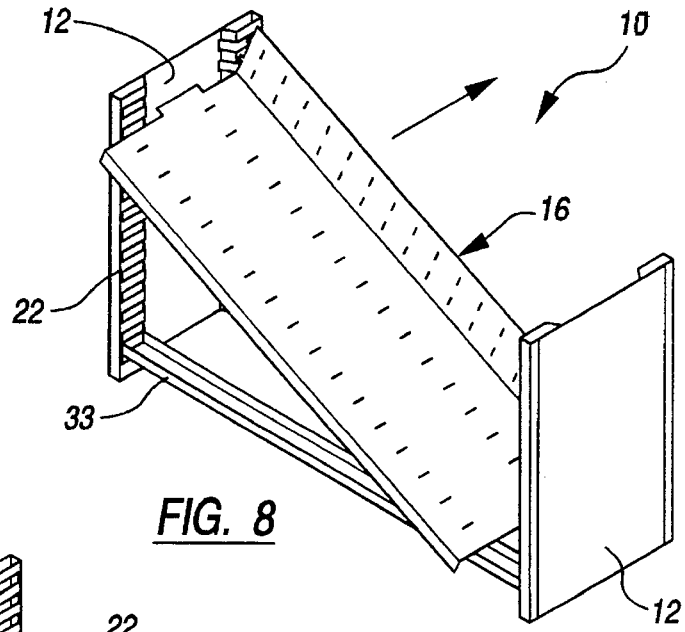
FIG. 8 is an isometric view of a portion of the shelving unit during assembly of a shelf.
Figure 9:
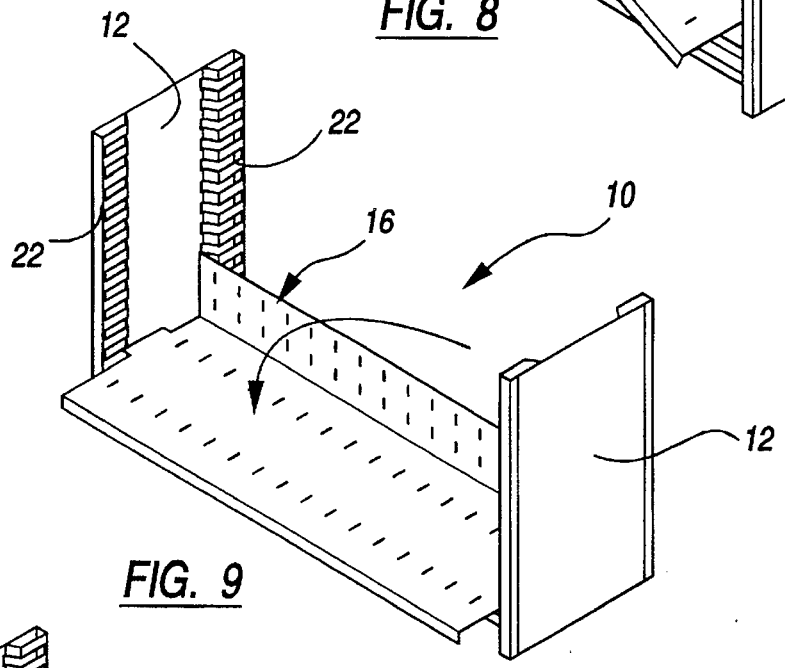
FIG. 9 is an isometric view of a portion of the shelving unit during another stage of assembly of a shelf.
Figure 10:
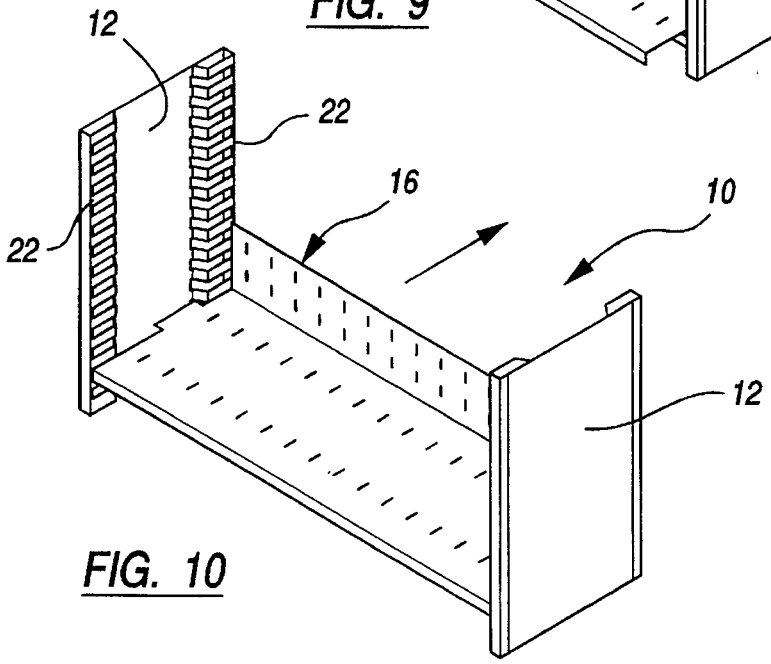
FIG. 10 is an isometric view of a portion of the shelving unit during a final stage of assembly of a shelf.

Turning now to FIG. 2, a portion of a rear, upper corner of a side wall 12 of the shelving unit 10 is illustrated in enlarged scale showing the corner upright support structure 20 of the present invention. Referring momentarily to FIGS. 8–10, it is seen that the corner structure 20 is formed along the front and rear marginal portions of the upstanding side walls 12. The corner support structures 20 of each side wall 12 are of identical but opposite hand construction.

The structure 20 includes generally C-shaped channel member 22 integrally formed with an end panel portion 24 of the side wall 12 which is made of sheet metal of suitable thickness. The panel portion 24 forms the body of the panel and is substantially planar. On two legs of the channel member 22, a plurality of slots 26 are formed at spaced vertical increments defining a plurality of rails 28 facing inwardly of the shelving unit 10. The channel member 22 also includes a reversely bent return flange 30 for strengthening the channel 22 construction. The flanges 30 are coplanar with the body portion of the panel. Pairs of spaced notches 32 are formed in the rails 28 for purposes which will be described in detail hereinafter.

The end panel 24 may be used by itself to form the side wall 12, or alternatively, a separate piece of sheet metal facing 13 (FIG. 1) may be used to cover the outside of panel 24. In the latter construction, the metal facing may be inserted behind the flanges 30 of the corner support structures 20 and fixed thereto as by welding. This serves to close off the exposed sides of the channel members 22 and gives the enclosure 10 a finished appearance as well as serving to strengthen the side wall 12 construction.

Figure 3:
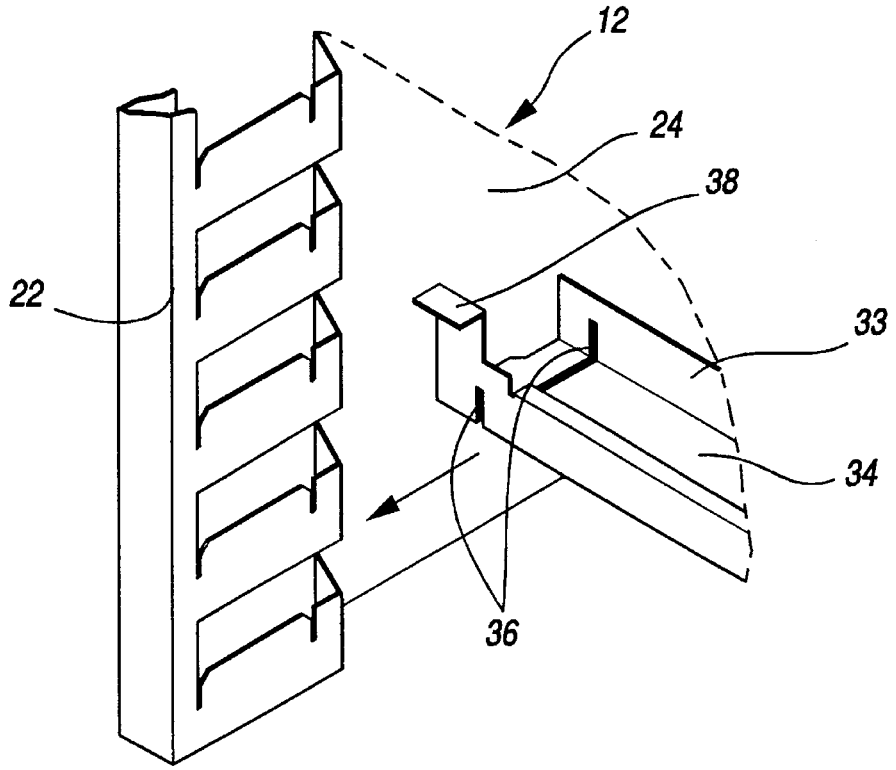
FIG. 3 is an enlarged fragmentary isometric view of a front corner of the shelving unit shown in FIG. 1 with a cross brace positioned to be connected to the corner support structure.
Figure 4:
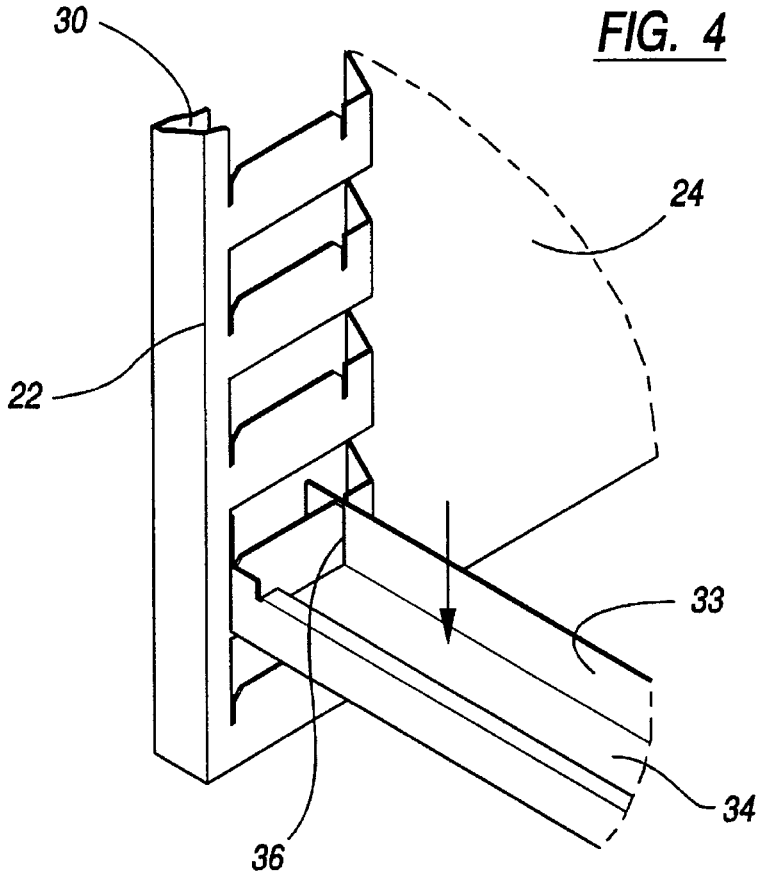
FIG. 4 is an enlarged fragmentary isometric view of a front corner of the shelving unit with a cross brace shown as connected to the corner support structure.

Referring now to FIG. 3, a lower, front corner of the shelving unit 10 is illustrated showing a cross brace 33 in a position to be connected to the channel member 22. The cross brace 33 extends between two side walls 12, only one of which can be seen in FIG. 3, and is a generally recumbent C-shaped channel member with an inwardly folded flange 34 for added strength. Each distal end of the brace 33 is provided with a pair of downwardly open notches 36 and an upwardly and outwardly extending bent tab 38. When the cross brace 33 is fully installed, as illustrated in FIG. 4, the notches 36 of the cross brace 33 cooperate and interengage with the notches 32 of the channel member rails 28 to seat the cross brace 33 and positively secure it to the channel member 22. In the installed position, the tab 38 fits into a space formed by flange 30 of the channel member 22 and serves to reinforce the connection between the cross brace 33 and channel member 22 assisting in preventing swaying of the shelving unit 10 enclosure.

Figure 5:
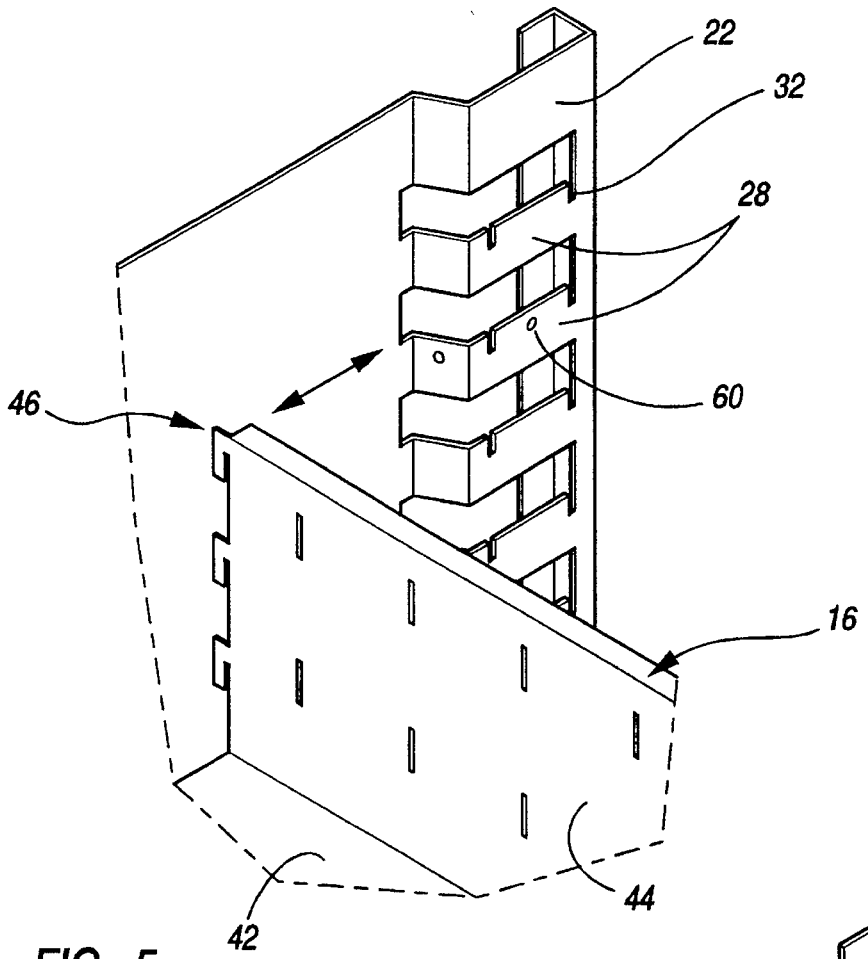
FIG. 5 is an enlarged fragmentary isometric view of a rear corner of the shelving unit with a shelf in position to be connected to the corner support structure.
Figure 6:
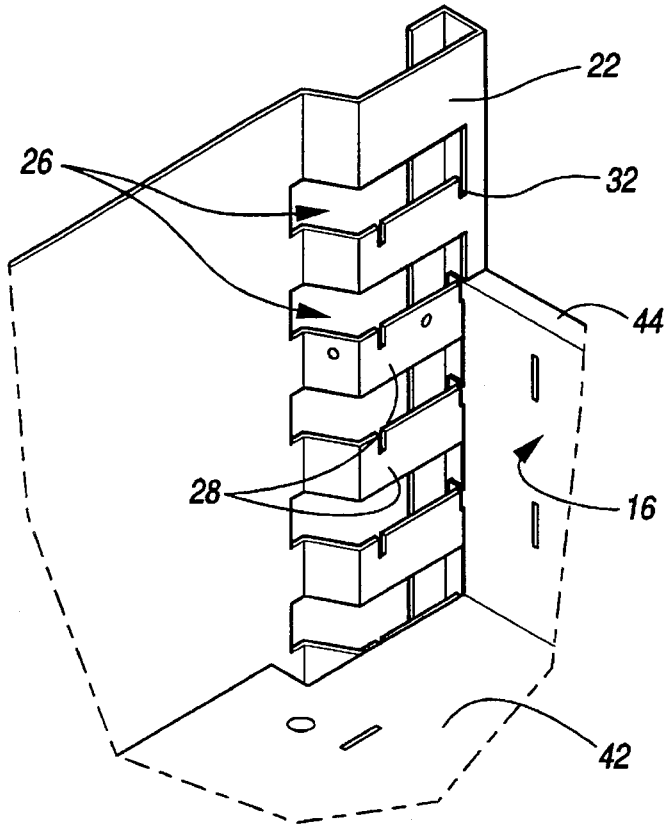
FIG. 6 is an enlarged fragmentary isometric view of a rear corner of the shelving unit with a shelf connected to the corner support structure.

FIG. 5 illustrates a rear corner of the shelving unit 10 with a shelf 16 in position to be connected to the channel member 22. The shelf 16 is generally L-shaped having a horizontal panel 42 and vertical back panel 44. Along the two end edges of the back panel 44, only one of which can be seen, hooks 46 are formed at spaced vertical intervals corresponding to the vertical intervals of the channel member rails 28. In FIG. 6, the shelf 16 is shown in fully installed condition with the hooks 46 of the back panel 44 engaging rear notches 32 of the rails 28. In a preferred embodiment, at least three hooks 46 are provided at each end of the back panel 44 of the shelf 16; this provides a high degree of strength of the shelving unit 10 to prevent swaying.

Figure 7:
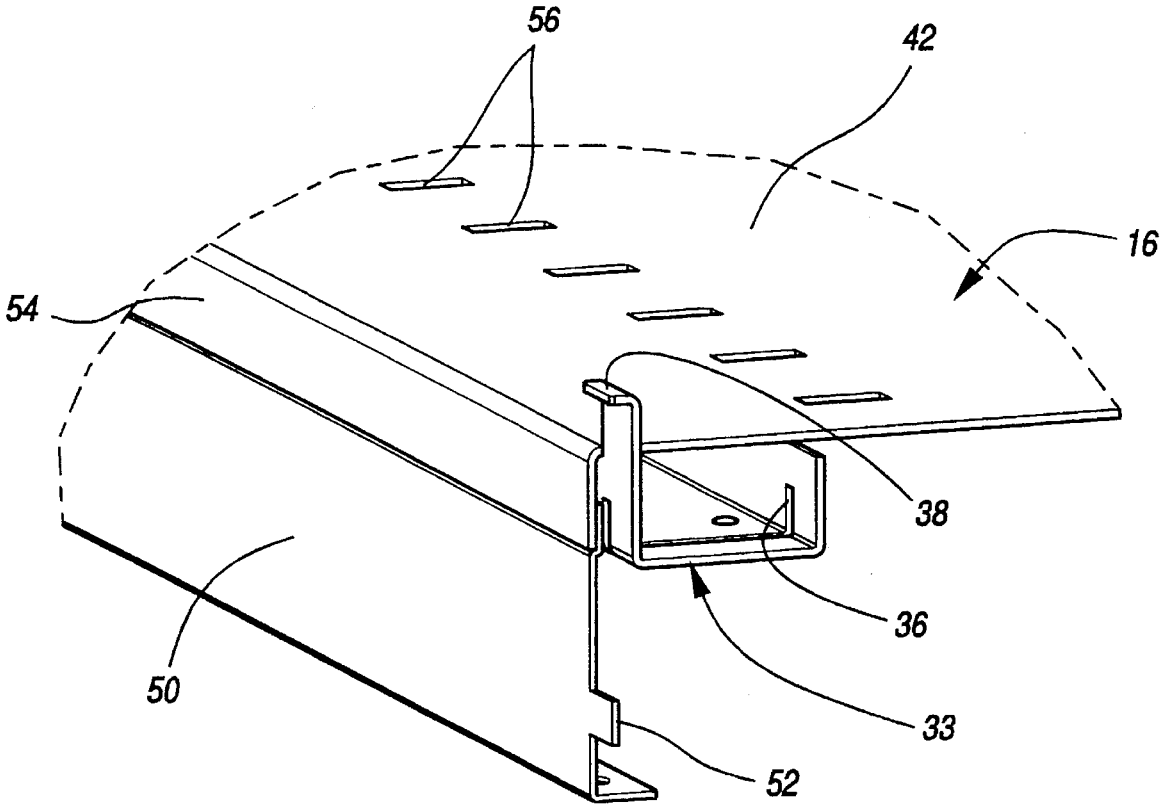
FIG. 7 is an enlarged fragmentary isometric view of a front corner of the bottom shelf of the shelving unit.

The relationships of the cross brace 33 and shelf 16 can best be seen in FIG. 7 wherein the side panel 12 is not shown for purposes of better ilustration. This illustration shows a front lower corner of the shelving unit 10 wherein a kick plate 50 is provided. The kick plate 50 has a laterally extending tab 52 which is formed as to be in registry with a forward notch 32 of the channel member 22. The kick plate 50 has a vertical dimension such that it laps over the forward surface of the lowermost cross brace 33. Panel 42 of the shelf has a downwardly turned lip 54 which not only serves to reinforce the shelf 16 but also overlaps the kick plate 50 to provide an aesthetically pleasing finished appearance to the bottom of the shelving unit 10. In the case of cross braces other than the lowermost cross brace, the horizontal panel 42 of each shelf rests on the upper front end rear surfaces of each cross brace 33.

Slots 56 may be provided in both panels 42 and 44 of the shelf 16 to receive tabs of dividers 58 (FIG. 1). These dividers may be of conventional construction.

It can now be appreciated that the shelving unit 10 of the present invention provides a strong, easy-to-assemble structure. In assembling the unit 10, a pair of end panels 12 are first connected by a plurality of cross braces 33 at preselected intervals of the channel members 22 corresponding to the desired positions of the shelves 16. Suitable indicia 60 (FIG. 5) may be provided on the rails 28, such as alternating square holes and round holes, to assist the installer in quickly locating the desired rails 28 which are to support the cross braces 32. Once the cross braces 33 are installed, the shelves 16 may be assembled into the unit 10.

As shown in FIGS. 8, 9 and 10, a shelf 16 can readily be installed by inserting it between the side panels 12 in a cocked position slightly forward of its final seated position. Then the shelf 16 is leveled with its forward edge resting on a respective cross brace 33. The shelf 16 is then simply moved back into the unit 10 such that its hooks 46 pass through respective slots 26 of the two opposed rear channel members 22 and come into registry with rear notches 32 of the associated rails 28. The rear edge of the shelf 16 is then pressed down such that the hooks 46 of the back panel 44 engage with the notches 32.

The present shelving unit 10 can be seen to provide a structure which is capable of being assembled by a single individual without the need for any tools. The unit 10 can also be easily manufactured by known stamping and forming techniques providing a unit 10 which can be economically made. No rivets or other mechanical fasteners are needed to assemble the unit 10 as is the case with numerous known shelving systems. Because of the novel construction of the channel members 22, less space interior to the unit 10 is dedicated to shelf support structure and, hence, more space is available to the user for storage. Of course, the channels 22 also act as columns for supporting the shelves and for imparting structural rigidity to the entire unit. The unit 10 can also be reconfigured without the need to do more than simply take out a shelf and move it to the new desired location.

While the present invention has been described in connection with a particular embodiment thereof, it will be understood by those skilled in the art that many changes and modifications may be made without departing from the true spirit and scope of the invention. Therefore, it is intended by the appended claims to cover all such changes and modifications as come within the true spirit and scope of the invention.

What is claimed is:

1. A side panel for a shelving unit comprising:

a generally rectangular panel formed from a unitary piece of sheet metal having a planar body portion and vertically disposed front and rear marginal portions in parallel spaced relationship with each other, said marginal portions being formed into generally C-shaped channels defining a pair of vertical parallel spaced uprights;

a plurality of vertically spaced horizontally extending slots formed in said uprights, said slots each having a generally L-shaped configuration formed through a face of each channel and an adjacent edge thereof defining a plurality of generally L-shaped horizontally extending rails with upper and lower edges; and at least one vertical notch formed in the upper edge of each rail, each notch being dimensioned and configured to receive and retain a hook formed on an associated shelf.

2. The side panel of claim 1 wherein each of said C-shaped channels projects from one face of the body portion of said panel thereby defining an opening at the other face of the panel.

3. The side panel of claim 2 further including a generally rectangular facing sheet substantially the same size as said panel, said facing sheet being secured to said panel on said other face thereof and thereby closing the openings formed by said C-shaped channels.

4. The side panel according to claim 3 wherein each C-shaped channel includes a vertically extending return flange coplanar with the body portion of the panel, said facing sheet being secured to said panel at least along the return flange of each channel.

5. The panel according to claim 1 wherein an additional vertical notch is formed in the upper edge of each rail.

6. A shelving unit comprising:

a pair of generally rectangular side panels each having vertically disposed front and rear marginal portions, each marginal portion being formed into a generally C-shaped channel having a face portion and associated edge portions and defining a vertical upright support member;

a plurality of vertically spaced horizontally extending slots formed in said uprights, said slots having a generally L-shape configuration formed through said face portion and an associated edge portion of each channel defining a plurality of generally L-shaped horizontally extending rails with upper and lower edges;

a plurality of notches formed in said upper edges of said rails in vertically-spaced relation relative one to another;

a shelf connected between said side panels, said shelf having means cooperating with selected notches for connection of said shelf to said side panel at a preselected vertical position.

7. The shelving unit of claim 6 wherein said rails project inwardly of said shelving unit toward said shelf.

8. The shelving unit of claim 6 wherein said shelf is provided with hooks along spaced opposed edges thereof and said hooks are received by said notches to support said shelf on said upright support members.

9. The shelving unit of claim 6 wherein said shelf is formed with a generally L-shaped cross-section defining a horizontal member and a vertical member.

10. The shelving unit of claim 9 wherein said vertical member is provided with hooks for cooperating with said notches to support said shelf on said upright support members.

11. The shelving unit of claim 6 further comprising a cross brace for interconnecting said side panels.

12. The shelving unit of claim 11 wherein a forward edge of said shelf is supported by said cross brace.

13. The shelving unit of claim 11 wherein said cross brace has a generally recumbent C-shaped cross-section.

14. The shelving unit of claim 11 wherein said cross brace is formed with a pair of hooks on each end for cooperation with a first pair and second pair of notches of respective rails.

15. The shelving unit of claim 6 wherein said rails are each provided with a pair of horizontally spaced notches.

16. The shelving unit of claim 6 wherein each of said C-shaped channels projects from one face of the body portion of one of said panels thereby defining an opening at the other face of the panel.

17. The shelving unit of claim 16 further including a generally rectangular facing sheet substantially the same size as one of said panels, said facing sheet being secured to a panel on said other face thereof and thereby closing the openings formed by said C-shaped channels.

18. The shelving unit of claim 17 wherein each C-shaped channel includes a vertically extending return flange coplanar with the body portion of the panel, said facing sheet being secured to a panel at least along the return flange of each channel.

19. A shelving unit comprising:

a pair of generally rectangular side panels each having vertically disposed front and rear marginal portions, each marginal portion being formed into a generally C-shaped channel defining a vertical upright support member;

a plurality of vertically spaced horizontally extending slots in each of said support members, said slots each having a generally L-shaped configuration formed through a face of each channel and an adjacent edge thereof defining a plurality of generally L-shaped horizontal extending vertically spaced rails on said support members;

at least one notch formed in each rail;

a shelf having a rear vertically disposed panel with opposed side edges; and at least one hook extending from each opposed edge of said shelf for cooperation with a selected notch to support the rear of said shelf between said side panels at the rear marginal portions thereof.

20. The shelving unit of claim 19 further comprising a cross brace extending between said pair of side panels for connection with the C-shaped channels at the front marginal portions of said side panels, said shelf having a horizontally disposed panel resting on and supported by the cross brace.

21. The shelving unit of claim 20 wherein said cross brace has a generally recumbent C-shaped cross-section.

22. The shelving unit of claim 21 wherein said cross brace is provided with a hook at each of its opposed ends for cooperation with opposed selected notches formed in the rails of the pair of side panels.

23. The shelving unit of claim 20 wherein said cross brace supports a forward portion of the horizontally disposed panel of the shelf.

24. The shelving unit of claim 19 wherein each of said C-shaped channels projects from one face of the body portion of one of said panels thereby defining an opening at the other face of the panel.

25. The shelving unit of claim 24 further including a generally rectangular facing sheet substantially the same size as one of said panels, said facing sheet being secured to a panel on said other face thereof and thereby closing the openings formed by said C-shaped channels.

26. The shelving unit of claim 25 wherein each C-shaped channel includes a vertically extending return flange coplanar with the body portion of the panel, said facing sheet being secured to a panel at least along the return flange of each channel.

* * * * *